United States Patent [19]

Marconnet

[11] Patent Number: 4,948,261

[45] Date of Patent: Aug. 14, 1990

[54] DEVICE FOR PREPARING BITUMINOUS COATED PRODUCTS, CONSISTING OF A DRUM

[75] Inventor: Guy Marconnet, Rive de Gier, France

[73] Assignee: Ermont C. M., Lorette, France

[21] Appl. No.: 365,389

[22] Filed: Jun. 13, 1989

[30] Foreign Application Priority Data

Jun. 13, 1988 [FR] France ..... 88 07856

[51] Int. Cl.[5] ..... B28C 5/46

[52] U.S. Cl. ..... 366/25; 366/147

[58] Field of Search ..... 366/22, 23, 24, 25, 366/4, 147, 144, 228, 57, 58, 229

[56] References Cited

U.S. PATENT DOCUMENTS 2,421,345 5/1947 McConnaughay .
4,215,941 8/1980 Mendenhall ..... 366/25
4,332,478 6/1982 Binz ..... 366/25
4,787,938 11/1988 Hawkins ..... 366/25

FOREIGN PATENT DOCUMENTS 0032468 7/1981 European Pat. Off. .
3423521 1/1986 Fed. Rep. of Germany .

*Primary Examiner*—Robert W. Jenkins
*Attorney, Agent, or Firm*—Pollock, Vande Sande & Priddy

[57] ABSTRACT

The solid materials circulating inside the drum are raised between a zone (22) in which the flame of the burner (12) is produced and a mixing zone (30) by raising vanes (18, 18') which form a dense screen of materials isolating the mixing zone (30) from the flame zone (22) as a result of the solid materials being raised and falling back down when the drum (2) is rotated. Recycled materials may be introduced into the zone (23) where the dense screen is formed.

4 Claims, 3 Drawing Sheets

DEVICE FOR PREPARING BITUMINOUS COATED PRODUCTS, CONSISTING OF A DRUM

FIELD OF THE INVENTION

The invention relates to a device for preparing bituminous coated products, using new aggregates and liquid bitumen and, if necessary, recycled bituminous mixes.

BACKGROUND OF THE INVENTION

Devices for preparing bituminous mixes for road surfaces, using virgin aggregates, liquid bitumen and powdery products into which, if necessary, recycled used bituminous mixes have been incorporated, are known. These devices generally consist of a cylindrical drum of large dimensions, mounted on a platform about its axis and slightly inclined relative to the horizontal plane. The virgin aggregates and the powdery products are introduced into the drum at one of its ends. The recycled mix in granular form is introduced via a recycling ring surrounding the drum in an intermediate zone between its two ends.

A burner penetrates inside the drum at one of its ends and enables hot gases to be circulated inside the drum, these hot gases ensuring drying and heating of the materials circulating inside the drum.

Such a drum carries out both drying and heating of the cold and moist aggregates entering into the drum, heating of the recycled mix and mixing of the new aggregates and recycled mix, in contact with liquid bitumen conveyed into the drum through an injection pipe.

The internal wall of the drum is equipped with vanes of varying shapes depending on the zones of the drum so as to ensure, as a result of rotation of the drum, transportation, stirring and/or raising of the materials circulating inside the drum.

Compared to the prior method where drying and heating of the aggregates were performed inside a rotating drier and mixing with the liquid bitumen inside a separate mixer having a fixed casing, the integration of drying, heating and mixing functions inside the same drum has led to a certain simplification of the procedures and materials involved. However, mixing/drying drums have the drawback that they give rise to the presence, inside the same enclosure, of a flame, of very hot gases and of liquid bitumen. This results in bitumen vapor being entrained by the hot gases circulating inside the drum, which in turn leads to rapid clogging of the bag filters used to extract the dust from the gases leaving the drum and to the release of harmful vapors into the atmosphere. These drawbacks are particularly marked in the case of parallel-flow mixing/drying drums, i.e., mixing/drying drums where the hot gases circulate inside the drum in the same direction as the solid materials.

Counter-flow mixing/drying drums have therefore been proposed, i.e., mixing/drying drums where the hot gases circulate inside the drum in the direction opposite to the direction of circulation of the solid materials, in which it is attempted as far as possible to prevent the hot gases produced by the burner from coming into contact with the material containing bitumen, such as the recycled materials or the aggregates being coated with liquid bitumen. To this end, use is made of a burner which has a very elongated body which penetrates inside the drum at its bottom outlet end, so that the end of the burner from where the flame is produced is located in a position relatively removed from the outlet of the drum. The zone for mixing the solid materials with the liquid bitumen as well as, if necessary, the zone for introducing, heating and mixing the recycled mix are arranged between the zone of the drum where the flame is produced and the outlet of the drum, around the body of the burner.

Such devices enable, to a large extent, the formation of bitumen vapor to be avoided, since the hot gases arising from the burner and circulating in the direction opposite to the virgin aggregates introduced via the inlet end of the drum are directed towards this inlet end, i.e., in the opposite direction to the zone or zones receiving bituminous materials.

However, these zones situated downstream of the flame remain exposed to the radiation of the flame, which may cause heating and vaporization of the bituminous products. Moreover, the extension of the flame towards the outlet of the drum is not perfectly controlled, such that this flame or hot gases may come into contact with the bituminous products, when the mixing zone is located immediately downstream of the flame zone.

To overcome these drawbacks, it has been proposed to arrange inside the cross-section of the drum, around the body of the burner, a metal shield in the form of a disk ensuring physical separation between the flame zone and the mixing zone. The need to provide a shield complicates the structure of the drum and reduces the cross-section through which the solid materials pass. Moreover, the shield is subject to degradation and rapid wear owing to the fact that it is situated in a very hot zone.

SUMMARY OF THE INVENTION

The object of the invention, therefore, is to provide a device for preparing bituminous coated products, using virgin aggregates and liquid bitumen and, if necessary, recycled bituminous mixes, comprising a cylindrical drum mounted for rotation about its axis and slightly inclined relative to the horizontal plane, a device for supplying cold and moist aggregates via the upper inlet end of the drum and a burner penetrating inside the drum via its lower outlet end and emerging inside a flame zone removed from the ends of the drum, such that the hot gases arising from the flame of the burner and the virgin aggregates circulate in opposite directions, the drum comprising, on its internal wall, in a mixing zone situated between the flame zone and the outlet end of the drum, vanes for mixing the solid materials circulating inside the drum and liquid bitumen introduced at the inlet of the mixing zone, this device enabling the flame zone to be separated perfectly from the drum zones receiving bituminous materials, without complicating the structure of the drum and disturbing its operation.

To this end, means for raising the circulating solid materials, integral with the internal wall of the drum, are arranged between the flame zone and the mixing zone so as to form a dense screen of materials isolating the mixing zone from the flame zone, as a result of the solid materials being raised and then falling back down over the entire cross-section of the drum when the drum is rotated.

BRIEF DESCRIPTION OF THE DRAWINGS

So that the invention may be properly understood, a description will now be given, by way of example, with reference to the accompanying drawings, of an embodiment of the device according to the invention.

DESCRIPTION OF PREFERRED EMBODIMENT

Figure 1:
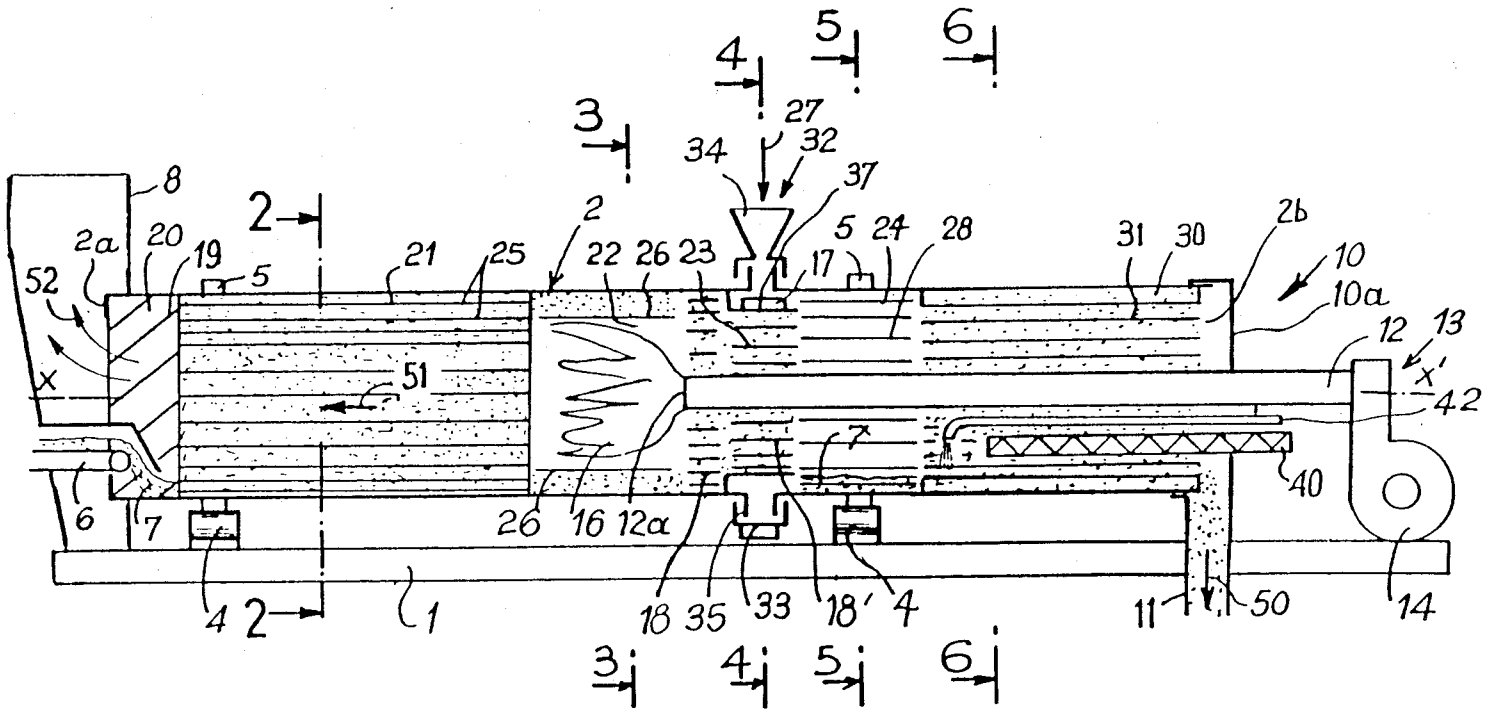
FIG. 1 is a longitudinal section and elevation view of the device according to the invention.

FIG. 1 shows the installation which comprises a platform 1 supporting the cylindrical drum 2 which is mounted on the platform for rotation about its axis XX'. The platform 1 comprises devices (not shown) for resting installation on the ground of the site and means for adjusting its inclination relative to the horizontal plane, enabling the inclination of the axis XX' of the drum 2 to be adjusted.

In the case of a movable station, the platform 1 may consist of the platform of a trailer having extendable and retractable forked support arms for positioning the device on the site.

The cylindrical casing of the drum 2 is mounted rotatably on the platform 1 about its axis XX', by means of four rolling wheels 4 and two rolling rings 5.

The drum 2 has a first end 2*a* or inlet end through which the outlet end of a conveyor belt 6 penetrates, enabling the drum to be supplied with cold and moist aggregates 7.

The inlet end 2*a* of the drum is engaged inside a box 8 for suctioning the gases circulating inside the drum.

The outlet end 2*b* of the drum, opposite to its inlet end 2*a*, is engaged inside a caisson 10, the bottom part 11 of which forms a chute for pouring out bituminous coated products leaving the drum via the its end 2*b*. The caisson 10 is fixed on the platform 1 and has a rear closing plate 10*a* through which passes the elongated cylindrical body 12 of a burner 13 comprising a fan 14 supported by the platform 1.

The body of the burner 12 arranged along the axis XX' of the drum 2 emerges with its end 12*a* inside the drum 2, at a certain distance from its outlet end 2*b* engaged inside the caisson 10.

The flame 16 of the burner is produced inside the drum, from the end 12*a* of the body 12 of the burner in a zone remote both from the inlet end 2*a* and the outlet end 2*b* of the drum.

The drum 2 has, along its length, several successive zones which differ from each other through the shape of the elements equipping the internal surface of the drum in the zone in question and through the function performed by this zone, when the device is in operation. From the end 2*a* of the drum to the outlet end 2*b*, the latter has an introduction zone 20, a drying zone 21, a flame zone 22, a zone for introducing recycled mixes 23, a heating and blending zone 24 and a mixing zone 30. As will be explained further below, a dense screen of solid materials falling back down in cascade fashion over the cross-section of the drum consists, in the recycling zone 23, of the solid materials circulating inside the drum, such that the zone 23 completely separates the zone 22 from the zones 24 and 30.

The zone 20 ensures rapid introduction of the aggregates 7 supplied to the drum by the conveyor 6 in the drying zone 21. In this zone, the internal wall of the drum 2 is equipped with fins 19 projecting radially relative to the internal surface of the drum and arranged along helices having as their axis the axis XX' of the drum.

Figure 2:
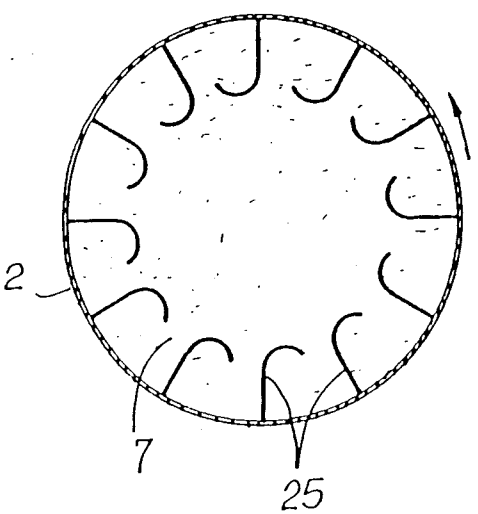
FIG. 2 is a section view along 2—2 of FIG. 1.
Figure 4:
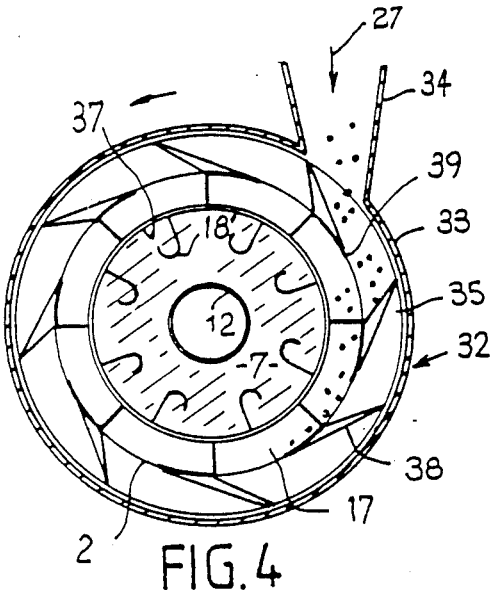
FIG. 4 is a section view along 4—4 of FIG. 1.

As can be seen in FIGS. 1 and 2, in the zone 21, the internal surface of the drum is equipped with raising vanes 25 whose cross-section, which may be hook-shaped, for example, enables the aggregates 7 to be raised to the upper part of the drum and to form a continuous screen of aggregates falling in cascade fashion over the cross-section of the drum during its rotation. The continuous screen of aggregates is passed through by the hot gases arising from the burner flame 16 situated in the zone 22 and circulating in the axial direction of the drum (Arrow 51). The drum is inclined so that its inlet end 2*a* is at a higher level than its outlet end 2*b*. The solid materials and in particular the aggregates 7 therefore circulate inside the drum in the direction opposite to the direction of circulation 51 of the hot gases. The cold and moist aggregates 7, upon entering the drum, are dried and heated by hot gases circulating in the opposite direction. On leaving the suction box 8 (arrows 52), the gases are laden with dust released by the aggregates 7 during drying thereof.

Figure 3:
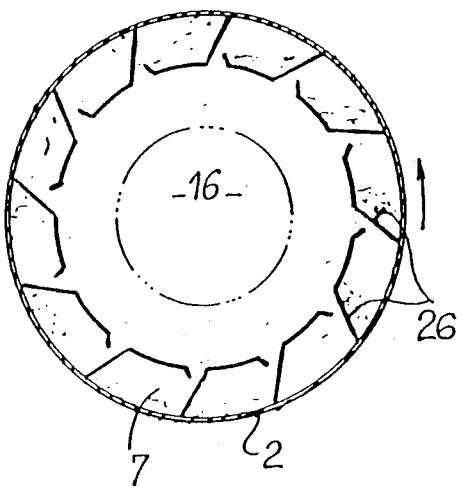
FIG. 3 is a section view along 3—3 of FIG. 1.

In the flame zone 22 (see FIG. 3), the internal wall of the drum 2 is equipped with vanes 26 enabling the aggregates 7 dried and heated in the zone 21 to be retained against the internal wall of the drum 2. The vane 26 consisting of strips of folded sheet metal have a concave section directed towards the wall of the drum and a practically flat external surface directed towards the flame 16.

The vanes 26, having a shape known in the art of drying and mixing drums, enable a free zone to be formed in the central part of the drum inside which the flame 16 can be produced.

In the zone 23, the drum 2 is surrounded by the recycling ring 32 which has a fixed annular part 33 forming at its top a hopper 34 for introducing recycled materials 27 and a moving annular part 35, integral with the external wall of the drum, comprising spouts and through-openings towards the inside of the drum, so as to channel the recycled materials poured into the hopper 34 inside the zone 23 of the drum.

In a known manner, a small internal drum 37 is coaxially fixed inside the drum 2 and ensures that the recycled materials introduced into the drum pass into the part of the zone 23 situated downstream of the recycling ring 32.

In the part of the zone 23 situated upstream of the recycling ring 32, the internal surface of the wall of the drum 2 is equipped with hook-shaped vanes 18 which ensure that the dried and heated aggregates 7 coming from the flame zone 22 and transported by the vanes 26 are raised and fall back down over the entire cross-section of the drum 2. Similarly, the internal surface of the small drum 37 is equipped with hook-shaped vanes 18' ensuring that the aggregates are raised over the entire cross-section of the drum 37.

It is quite obvious that the zone 23 thus ensures complete separation between the zone 22 where the flame 16 is produced and the zones 24 and 30 situated downstream. Separation is ensured on the one hand by the dense screen of solid materials formed both by the vanes 18 over the entire cross-section of the drum 2 and by the rotating part of the recycling ring integral with the casing of the drum 2 and the dense screen of solid aggregates formed over the entire cross-section of the small drum 37 by the vanes 18', during rotation of the drum.

Helical fins 17 are fixed on the external surface of the drum 37 and ensure transportation, towards the zone 24, of the recycled mix 27 introduced via the hopper 34.

The aggregates 7 reach the zone 24 via the internal part of the drum 37, while the recycled coated products 27 reach this zone 24 via the external part of the drum 37.

Figure 5:
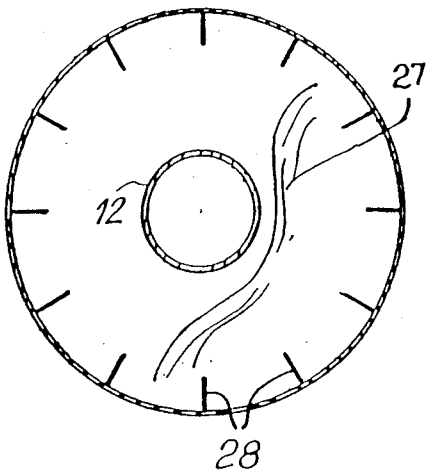
FIG. 5 is a section view along 5—5 of FIG. 1.

In the zone 24 situated downstream of the zone 23 for introducing recycled mixes (see FIG. 5), the internal surface of the drum 2 is equipped with flat vanes 28. The recycled materials 27 introduced into the drum are mixed, by the action of the vanes 28 during rotation of the drum, with the aggregates 7 coming from the drying zone 21 via the flame zone 22 and the drum 37.

The vanes 28 stir the bed of granular materials consisting of the aggregates 7 and the bituminous mix 27. Stirring is performed without significant raising of the bed of materials which remains in contact with the wall of the drum.

The aggregates entering into the zone 24 have been dried and heated in the zone 21 and are therefore at a high temperature when they come into contact with the recycled mix 27. The recycled coated materials are therefore heated by contact with the aggregates, resulting in softening and melting of the bitumen layer covering the recycled mix. The molten bitumen covers the aggregates at least partially during mixing such that, at the outlet **2*b* of the drum, the products being poured into the mixing zone 30** consist partly of the recycled materials covered with molten bitumen and partly of the pre-coated aggregates.

Heating of the recycled mix and mixing with the aggregates are carried out in a calm zone which is not subjected to the circulation of the hot gases arising in the zone 22, at the outlet **12*a* of the burner 13**.

Figure 6:
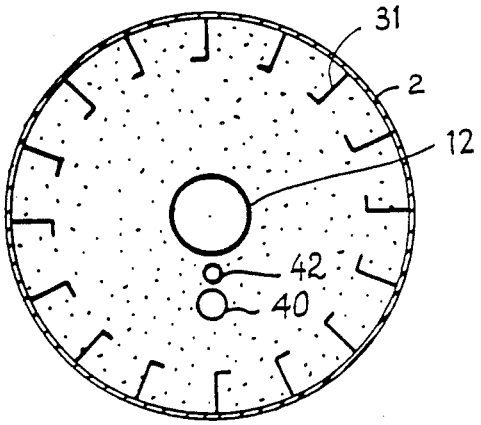
FIG. 6 is a section view along 6—6 of FIG. 1.

In the mixing zone 30 which extends from the outlet of the blending zone 24 to the end **2*b* of the drum, the internal surface of the wall of the drum 2 is equipped with L-shaped vanes 31 which are visible in FIG. 6. A pipe 42 for injecting bitumen passing through the rear wall 10*a* of the caisson 10 penetrates into the drum through its end 2*b* and emerges at the inlet of the mixing zone 30. Moreover, a device 40 for transporting powdery products formed by a tube inside which a screw conveyor rotates also passes through the plate 10*a* so as to penetrate longitudinally into the drum and emerge at the inlet of the mixing zone 30 slightly downstream of the end of the injection pipe 42**. In this way, the solid materials introduced into the mixing zone are first coated with bitumen, and a certain quantity of powdery product is then added to them, enabling the composition of the bituminous material to be adjusted during processing in the drum.

The hot pre-coated materials leaving the heating and blending zone 24 are then sprayed with bitumen upon entering the mixing zone 30. A powdery material is, if necessary, added to the pre-coated material sprayed with bitumen, the powdery material thus being retained through adhesion, by the bitumen. Any entrainment of fine materials in the outlet part of the drum is thus avoided, thereby preventing the discharge of dust-containing gases and ensuring perfect metering of the quantity of powdery product in the mix processed in the mixing zone.

As can be seen in FIG. 6, the vanes 31 ensure raising of the materials during mixing with the bitumen in the zone 30, up to the highest point of the drum, followed by these materials falling back down, in the form of a rain, over practically the entire cross-section of the drum. Intense stirring of the mixture consisting of the hot pre-coated aggregates and the liquid bitumen is thus obtained. This intense stirring produces thorough mixing throughout the zone 30. Furthermore, the pre-coated aggregates reaching the inlet of the zone 30 are at a high temperature, the aggregates 7 having been greatly superheated in the zones 21 and 22. Mixing with the recycled mix in a proportion which may be, for example, of the order of 80% produces only limited cooling of these aggregates, such that these pre-coated aggregates resulting from the mixing of the new aggregates 7 and the recycled mix 27 are, at the inlet into the zone 30, at a temperature favoring a good coating action.

At the outlet of the zone 30, the bituminous coated products 50 poured into the chute 11 are therefore of a very good quality.

The dense screen of materials consisting of the aggregates falling back down over the cross-section of the drum, inside the zone 23, enables the operation and performances of the drying and mixing drum to be improved considerably, in particular as regards the points which will be mentioned below.

As has been mentioned above, the screen of materials forms a shield protecting the heating and blending zone 24 and all the more so the mixing zone 30 from the flame 16 of the burner. The bitumen or bituminous products introduced into these zones 24 and 30 is therefore not subjected to excessive heating, and its rate of vaporization is very low. Furthermore, the small quantity of bitumen vapor formed in the zones 24 and 30 is sucked through the screen of materials of the zone 23 which enables part of the bitumen vapors to be condensed and retained. In this way, the screen plays the part of an active filter. The very small quantity of vapor reaching the zone 22 is burned by the flame 16 of the burner. The flow of gases 51 circulating in the zone 21 in the direction of the suction box 8 therefore no longer contains any bitumen vapor. It should be noted that the vapor flow passing through the screen of the zone 23 is finely divided, thereby facilitating its combustion in the zone 22.

The dense screen of materials in the zone 23 moreover offers the advantage of permitting efficient recovery of the thermal energy released by the flame of the burner in the direction of the outlet of the drum. This thermal energy is transmitted to the aggregates, mainly through radiation. The thermal efficiency of the drying-/mixing drum is thus increased.

Compared to prior art installations comprising a separate drying drum and a mixer with fixed casing, the device according to the invention has the advantage of greater simplicity and lower cost since it consists of a simple drum rotating in continuous operation. Moreover, the presence of the screen of materials enables, the discharges of bitumen vapor to be almost entirely eliminated. In prior art installations comprising a mixer separate from the drying drum; these discharges, while small, were not non-existent; and even this result was obtained only with an installation which was more complex as regards its structure and operation.

Compared to the mixing/drying drum in which the gases circulate in the opposite direction, comprising a metal shield separating the flame zone from the zones receiving the bituminous products, the device according to the invention has the advantage of using a shield consisting of a screen of materials, i.e., an element which is not subject to wear and the gas filtration and dispersion functions of which cannot be obtained using a metal shield. Furthermore, the circulation of the aggregates inside the drum is not disturbed in any way.

It should be noted that in the heating and blending zone 24, the superheated aggregates 7 are brought into intimate contact with the recycled mix 27 by means of the flat vanes 28 which ensure gentle stirring of the mixture and which slow down the speed of forward movement inside the drum 2. However, the solid materials remain massed against the wall of the drum and any release of the bitumen vapors in this zone is very limited.

The powdery product or filler which is introduced by the device 40 is immediately captured by the precoated products or the liquid bitumen at the inlet of the zone 30. Entrainment of filler is thus avoided and, if this entrainment nevertheless occurs to a limited extent, the filler is captured by the coated materials which fall as a rain inside the drum and which form a filter for the very weak gaseous flow circulating in the end part of the drum.

The filler introduced into the mix may consist totally or partially of the fines recovered in the gases escaping through the suction box 8 or of a powdery material with a fine grain size, such as cement.

The invention may apply very advantageously to a drying/mixing drum in which there is no recycling of mixes. In this case, the dense screen of material is formed in a zone situated downstream of the flame zone and upstream of the end mixing zone of the drum. In the zone where the screen is formed, the drum comprises raising vanes, for example of the type consisting of hook-shaped vanes having a good capacity for retaining the materials. Several sets of successive staggered vanes may be used to make the screen more dense. This zone where the screen is formed may replace both the zone 23 and the zone 24 of the drum described in the illustrated embodiment.

In the case of a drum allowing recycling of a bituminous mix and comprising a zone such as the zone 23 inside which a small drum, such as the drum 37, ensures that the recycled mix is introduced into a heating and blending zone, this small drum may be arranged along the entire length of the zone for introducing the recycled products or, on the other hand, along only a part of the length of this zone, as in the case of the device which has been described.

This second arrangement is advantageous since it makes it easier for the dry aggregates to pass from the large diameter part to the small diameter part of the zone for introducing the recycled products. Moreover, this arrangement enables a dense screen to be created over the entire cross-section of the drum immediately downstream of the flame zone.

Finally, the device according to the invention may be used for manufacturing any bituminous coated product, using virgin aggregates and liquid bitumen alone or with recycled bituminous mixes.

We claim:

1. Device for preparing bituminous coated products from virgin aggregates, recycled bituminous mixes and liquid bitumen, comprising (a) a cylindrical main drum mounted for rotation about an axis (XX') of said main drum and inclined relative to a horizontal plane;

(b) a device for supplying virgin aggregates in a cold and moist state, via an upper inlet end of said main drum; and (c) a burner penetrating inside said main drum via a lower outlet end of said main drum and emerging inside a flame zone remote from inlet and outlet ends of said main drum, such that hot gases arising from a flame of said burner and said virgin aggregates circulate in opposite directions;

(d) said main drum comprising a mixing zone situated between said flame zone and said outlet end of said main drum, in which mixing zone an internal wall of said main drum is provided with vanes for mixing solid materials circulating inside said main drum with liquid bitumen introduced at an inlet of said mixing zone and a zone for introducing recycled bituminous mixes into said main drum located between said flame zone and said mixing zone;

(e) a second drum of smaller diameter than a diameter of said main drum arranged inside and coaxially with said main drum, raising vanes being fixed on an internal wall of said second drum for raising solid materials circulating inside said main drum, so as to form a dense screen of materials isolating said mixing zone from said flame zone, as a result of said solid materials being raised and then falling back down over an entire section of said second drum when said main drum is rotated.

2. Device according to claim 1, wherein additional raising vanes are fixed on said internal wall of said main drum between said flame zone and said zone for introducing recycled mixes so as to form a dense screen of materials over an entire section of said main drum.

3. Device according to claim 1, wherein said raising vanes (18, 18') are hook-shaped in a cross-sectional plane of said second drum.

4. Device according to claim 1, comprising, inside said main drum, in sequence from its inlet end (2*a*) to its outlet end (2*b*):

(a) an introduction zone (20) where the internal surface of said main drum is equipped with projecting vanes (24) arranged along helices coaxial with said axis (XX') of said main drum;

(b) a drying zone (21) in which said internal surface of the drum is equipped with raising vanes (25);

(c) said flame zone (22) in which said internal surface of said main drum is equipped with vanes (26) for retaining the materials against said internal surface of said main drum;

(d) said zone (23) for introducing recycled mixes into said main drum in which said second drum carries raising vanes, so as to form a dense screen of materials across the entire cross-section of said main drum with the materials circulating inside said main drum when said main drum is rotated; and (e) said mixing zone (30) inside which said internal surface of said main drum is equipped with vanes for raising said materials, and inside which a device (42) for introducing bitumen debouches into said mixing zone.

* * * * *